US005107200A

United States Patent [19]

Dohnal et al.

[11] Patent Number: 5,107,200

[45] Date of Patent: Apr. 21, 1992

[54] LOAD SWITCH FOR A STEP TRANSFORMER

[75] Inventors: Dieter Dohnal, Lappersdorf; Josef Neumeyer, Waldetzenberg, both of Fed. Rep. of Germany

[73] Assignee: Maschinenfabrik Reinhausen GmbH, Regensburg, Fed. Rep. of Germany

[21] Appl. No.: 675,566

[22] Filed: Mar. 27, 1991

[30] Foreign Application Priority Data

Apr. 5, 1990 [DE] Fed. Rep. of Germany ..... 4011019

[51] Int. Cl.[5] ..... H01F 29/04

[52] U.S. Cl. ..... 323/340; 200/11 TC; 323/341; 336/150

[58] Field of Search ..... 200/11 TC, 18; 323/340, 323/341, 342; 336/150

[56] References Cited

U.S. PATENT DOCUMENTS 3,421,073 1/1969 Perkins .
3,622,867 11/1971 Topper et al. .
3,720,867 3/1973 Rathbun ..... 323/341
3,813,503 5/1974 Breuer ..... 200/11 TC

FOREIGN PATENT DOCUMENTS 1917692 9/1972 Fed. Rep. of Germany .
2021575 5/1973 Fed. Rep. of Germany .

*Primary Examiner*—William H. Beha, Jr.
*Attorney, Agent, or Firm*—Herbert Dubno; Andrew Wilford

[57] ABSTRACT

A switching system for a step transformer having at least two adjacent taps and a pair of terminals shiftable between the taps has a pair of fixed contacts normally connected to the terminals, a vacuum interrupter connected between the terminals and displaceable between an open-circuit position and a closed-circuit position, a pair of movable contacts each engageable with a respective one of the fixed contacts and forming therewith a respective bypass switch, and a cam rotatable about a cam axis and having a contact face and an axially oppositely facing interrupter face each formed with a respective operating formation. A drive rotates the cam about its axis through steps of a half revolution. A respective cam follower engaged between each of the movable contacts and the contact-face formation opens and closes one of the bypass switches on rotation of the cam through a half revolution and thereafter opens and closes the other of the bypass switches on rotation of the cam through a succeeding half revolution. Another cam follower and a force storer engaged between the interrupter and the interrupter-face formation snap the interrupter open and then snap it closed each time the cam is rotated through a half revolution.

13 Claims, 4 Drawing Sheets

Position 1

Position 2

LOAD SWITCH FOR A STEP TRANSFORMER

FIELD OF THE INVENTION

The present invention relates to a step transformer. More particularly this invention concerns a load switch for switching along the taps of such a step transformer.

BRIEF DESCRIPTION OF THE DRAWING

The above and other objects, features, and advantages will become more readily apparent from the following, reference being made to the accompanying drawing in which.

Figure 3:
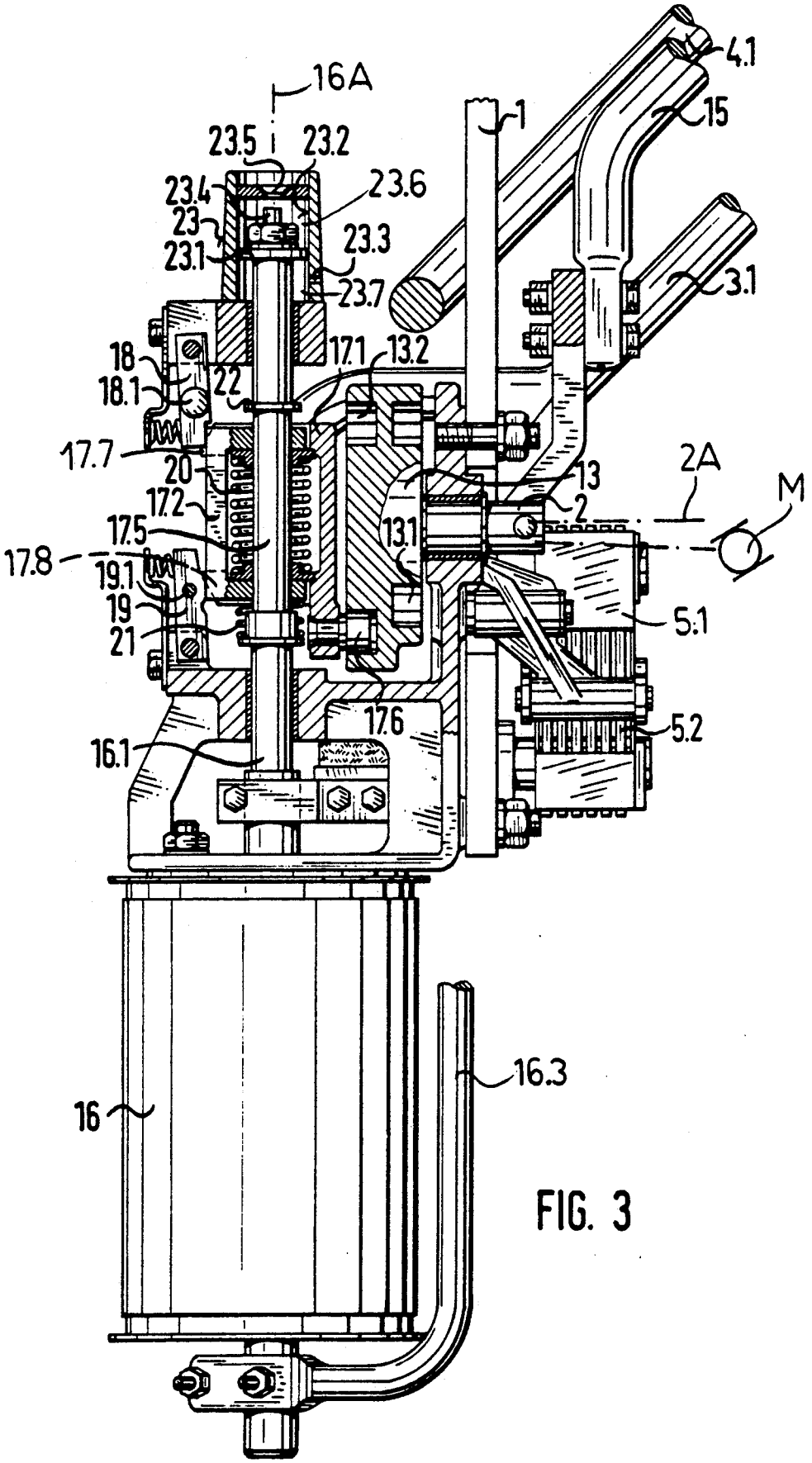

FIG. **2*a*** is a front view of the switch according to this invention;

FIG. **2*b*** is a back view of the switch;

FIG. 3 is a side view partly in section of the switch; and

FIGS. **4*a* and 4*b*** are large-scale views of the opposite faces of the operating cam of the switch.

BACKGROUND OF THE INVENTION

In order to switch from one tap to the adjacent tap of a step transformer it is standard to provide two movable terminals. Current flow through one of them is cut and it is moved to the next tap, then flow is restored, current flow to the other terminal is cut and it is moved to join the first one. In this manner switching under heavy load and the resultant arcing is minimized.

In order further to minimize arcing it is known from German patent document 1,917,692 of K. Fricke to use four vacuum interrupters per phase, two of which are provided with intermediate current-limiters. They are sequentially actuated by means of respective cams. Similarly in German patent document 2,021,575 of K. Fricke et al four vacuum interrupters are used. They are actuated in pairs by means of respective cam setups. Both these systems are therefore quite complicated.

Figure 1A:
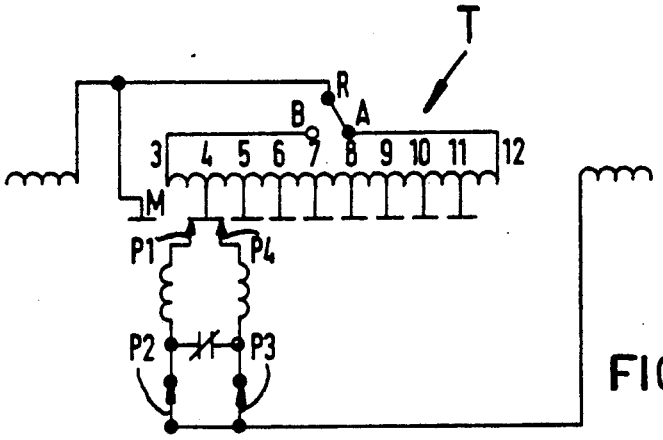
FIG. 1A is a schematic view of a standard prior-art step-transformer switch.
Figure 1B:
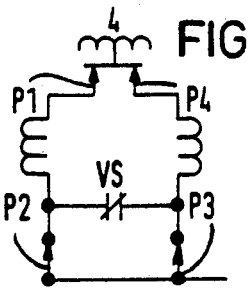
FIGS. 1B through 1G are detail views illustrating successive stages of operation of the stepping switch.
Figure 1C:
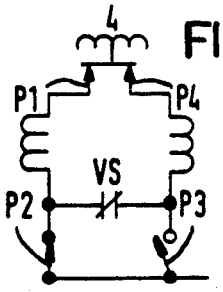
Figure 1D:
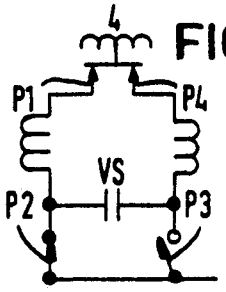
Figure 1E:
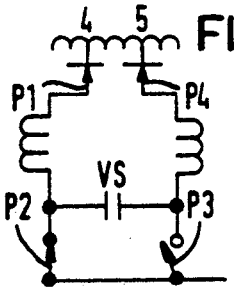
Figure 1F:
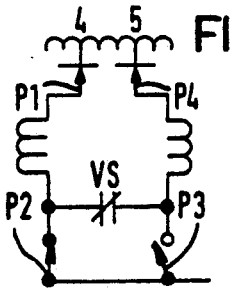
Figure 1G:
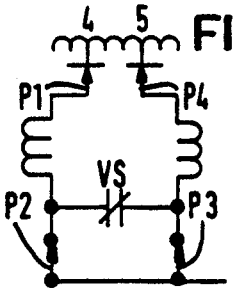

In the UVT system described in more detail in commonly assigned patent application Ser. No. 07/673,206, filed Mar. 21, 1991 only one vacuum interrupter is used as illustrated in FIGS. 1A through 1G. In this arrangement the vacuum interrupter is snapped open by a spring-loaded force storer. With this arrangement in a standard step transformer T two terminals P1 and P4 are normally both connected to a single one of the twelve taps and normally are both shorted out both by a vacuum interrupter VS and by a pair of bypass switches P2 and P3 so that they are connected in parallel. To move to the adjacent terminal of the transformer T first of all the bypass switch P3 is opened (FIG. 1C) and then the vacuum interrupter (1D). Then the one terminal P4, which is effectively completely disconnected, is moved to the next terminal (FIG. 1E), the vacuum interrupter VS is closed (FIG. 1F) to restore flow through this terminal P4, and the bypass switch P3 is closed (FIG. 1G). The sequence is then repeated with the bypass switch P2 for the trailing terminal P1, first open circuiting it and then moving it over to join the terminal P4 before restoring current flow to it through the vacuum interrupter VS and the switch P2.

In this manner current flows continuously during switching, but each terminal is moved under relatively light load. The vacuum interrupter is capable of opening and closing under substantial load and is operated by a spring-loaded force-storing unit to limit arcing as much as possible. The bypass switch is only opened or closed when the interrupter in parallel to it is closed so it is not likely to arc much either.

In such a system the force storer opens the interrupter and it is mechanically latched in the open position while the terminal is moved to the next tap on the transformer. Once the new tap is reached, the mechanical latch is released and atmospheric pressure closes the vacuum interrupter. Thus, closing speed is a function of instantaneous atmospheric pressure, so that there is some variation in function depending on local conditions.

Furthermore with this known system the double bypass system must be separately actuated by another mechanical system. The bypass switch actually is a pair of SPST switches each in series with a respective one of the shiftable tap terminals, so that this mechanism can be fairly complex. Typically the bypass switch unit is an arcuate slide-type arrangement that moves past two fixed contacts, sequentially making and breaking contacts and capable of residing in a middle position touching both contacts.

OBJECTS OF THE INVENTION

It is therefore an object of the present invention to provide an improved switching system for a step transformer.

Another object is the provision of such an improved switching system for a step transformer which overcomes the above-given disadvantages, that is which is relatively simple, yet which operates surely and reliably and that needs only a single vacuum interrupter for each phase.

A further object is the provision of such a switching system which is not affected by atmospheric pressure.

SUMMARY OF THE INVENTION

A switching system for a step transformer having at least two adjacent taps and a pair of terminals shiftable between the taps has a pair of fixed contacts normally connected to the terminals and fixed on a support, a vacuum interrupter on the support connected between the terminals and displaceable between an open-circuit position and a closed-circuit position, a pair of movable contacts on the support each engageable with a respective one of the fixed contacts and forming therewith a respective bypass switch, and a cam rotatable about a cam axis and having a contact face and an axially oppositely facing interrupter face each formed with a respective operating formation. A drive rotates the cam about its axis through steps of a half revolution. A respective cam follower engaged between each of the movable contacts and the contact-face formation opens and closes one of the bypass switches on rotation of the cam through a half revolution and thereafter opens and closes the other of the bypass switches on rotation of the cam through a succeeding half revolution. Another cam follower and a force storer engaged between the interrupter and the interrupter-face formation snap the interrupter open and then snap it closed each time the cam is rotated through a half revolution.

Thus according to this invention a single cam is responsible for actuating both of the bypass switches and the vacuum interrupter. The structure is therefore extremely compact, and synchronization is positively ensured.

According to this invention the contact-face formation is an annular groove and has one half that is generally centered on the cam axis and another half that is not centered on the cam axis. Thus the contact cam follower engaging the one centered half is not moved radially while the contact cam follower engaging the other uncentered half is moved radially on rotation of the cam. The interrupter-face formation is another annular groove generally symmetrical to two planes meeting at the cam axis so that the interrupter cam follower moves identically with each half revolution of the cam.

Each movable contact according to the invention includes a stack of separate contact plates engageable with the respective fixed contact and a frame surrounding the respective stack of plates. One of the plates of each movable contact is mounted in the frame for greater displacement than the other plates of the respective stack and is made at least where it engages the respective fixed contact of tungsten. Thus any arcing in the bypass switch will be at this tungsten electrode, while the remaining plates can be of cheaper construction. In addition this structure allows the system to be set up for different current ratings without having to make substantial structural changes, just by changing the number of plates in each movable-contact stack.

The force storer according to the invention has an outer housing displaceable on the support and carrying the interrupter cam follower, an inner housing displaceable on the support parallel and relative to the outer housing, and a spring braced between the housings. The housing includes guide rods along which the outer housing is slidable and a latch system is provided for restraining the inner housing against movement on the housing during movement of the outer housing until the outer housing has moved through a predetermined stroke. The interrupter has an actuating rod and the force storer has a spring braced between the inner housing and the rod.

It is also within the scope of this invention to provide a damper for movement of the actuating rod at the ends of its stroke. This damper can include a cylinder fixed on the housing and a piston carried on the rod and subdividing the cylinder into a pair of generally closed compartments. Each of the compartments is formed with a vent aperture of limited flow cross section.

Furthermore according to this invention the cam formations are provided with seats for the respective cam followers and the cam followers are received stably therein in two 180° offset positions of the cam.

SPECIFIC DESCRIPTION

Figure 2A:
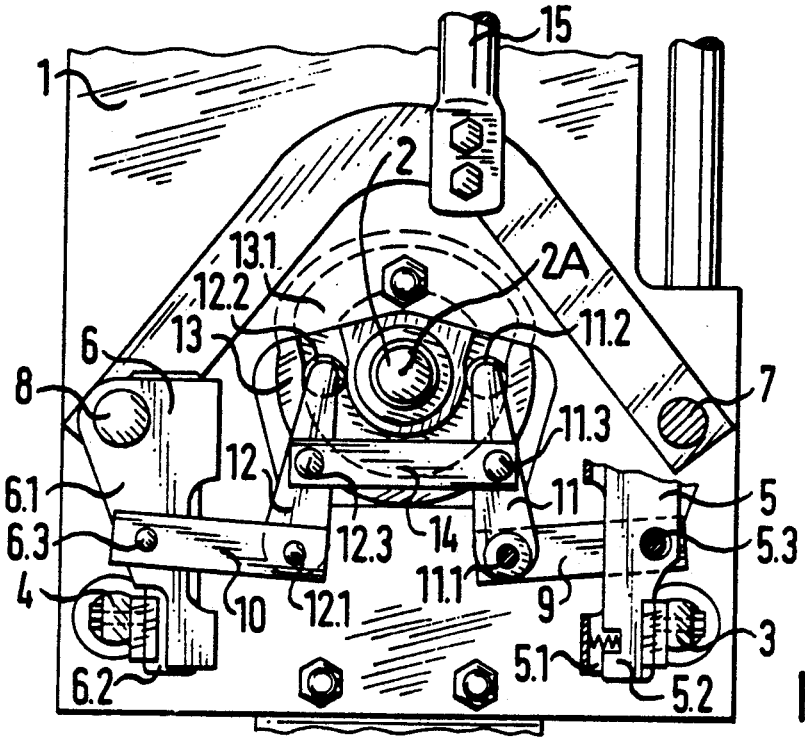
Figure 2B:
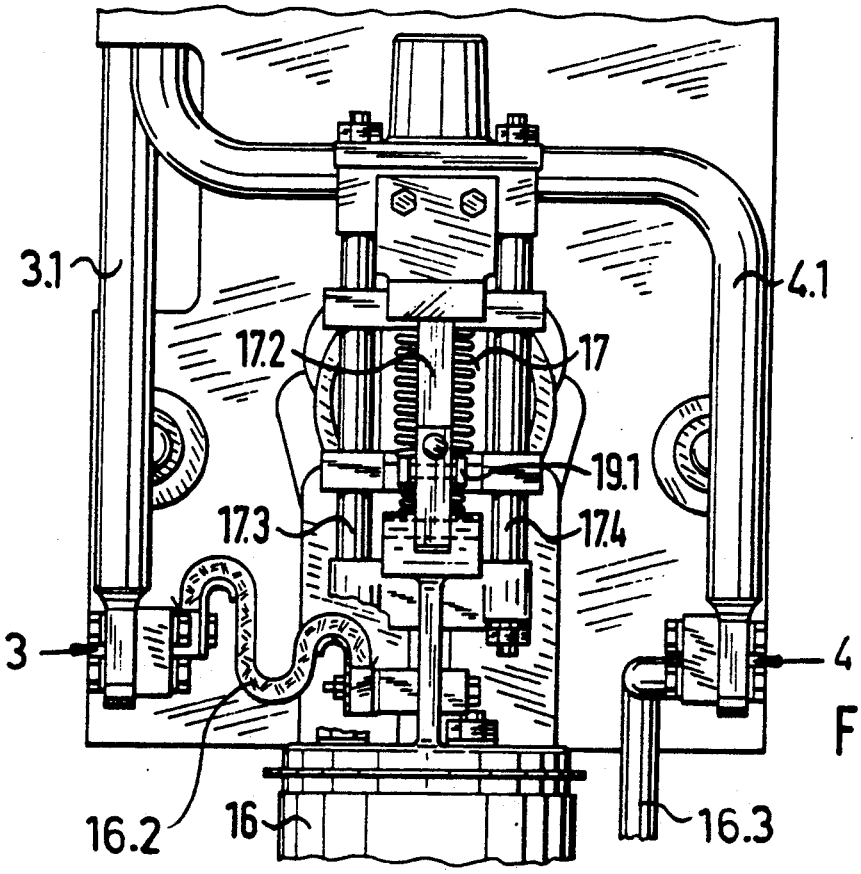

As seen in FIGS. 2*a*, 2*b*, and 3, a tap-switching system according to this invention has an insulating-body support 1 traversed by a drive shaft 2 connected to a motor illustrated schematically at M. A pair of fixed contacts 3 and 4 are mounted on this support 1 and are connected via respective conductors 3.1 and 4.1 to standard respective wiper terminals of the type shown schematically at P1 and P4 in FIG. 1.

Respective contact assemblies 5 and 6 best seen in FIGS. 2*a* and 3 are engageable with the contacts 3 and 4 to connect them with a common feed line 15 in accordance with the switching cycle half of which is shown in FIGS. 1B through 1G. These assemblies 5 and 6 comprise respective frames 5.1 and 6.1 pivoted at upper respective pivots 7 and 8 on the support 1 and each containing a stack of contact plates 5.2 and 6.2. One of the plates 5.2 and one of the plates 6.2 is made of tungsten and is mounted somewhat more loosely than the others so that it is the last to move away from the respective fixed contact 3 and 4. Thus the inevitable minor arcing will all be confined to this tungsten plate, which can withstand it better than the remaining plates which can be of cheaper construction. The number of plates 5.2 and 6.2 in each assembly 5 and 6 is determined by the amount of current being conducted, making it easy to adapt the system to different loads.

Links 9 and 10 have outer ends pivoted at 5.3 and 6.3 on the assemblies 5 and 6 intermediate their ends and inner ends pivoted at 11.1 and 12.1 on the lower ends of follower levers 11 and 12 having upper ends carrying follower rollers 11.2 and 12.2 riding in a groove 13.1 of a cam 13 carried on the shaft 2. Another link 14 is connected between the levers 11 and 12, being pivoted in their centers at pivots 11.3 and 12.3.

Figure 4A:
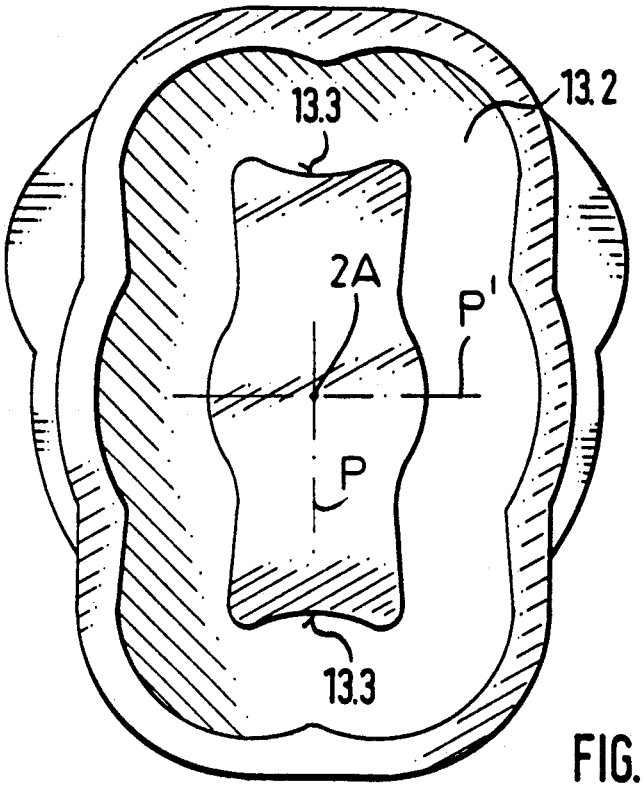
Figure 4B:
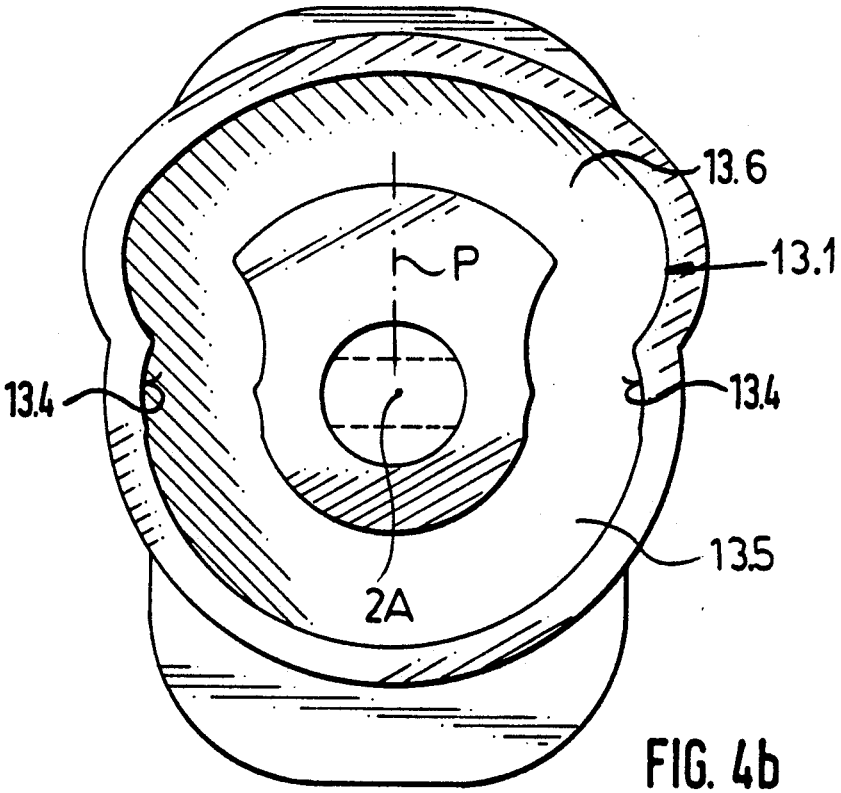

The cam groove 13.1 is symmetrical as shown in FIG. 4*b* about a plane P but has at one side a lobe 13.5 of substantially smaller diameter than its other lobe 13.6, and these two lobes 13.5 and 13.6 meet at locations 13.4 where the rollers 11.2 and 12.2 rest between successive 180° revolutions of the shaft 2 and can 13. The lobe 13.5 has a center of curvature at the axis 2A of the shaft 2 so that the follower roller engaged in it will not be moved radially of the axis 2A as the cam 13 executes a half revolution. The follower roller engaged in the large-diameter lobe 13.6 will however be moved in a manner to pull the respective contact assembly 5 or 6 out of engagement with the respective fixed contact 3 or 4 and then return it back to engagement therewith.

On the opposite side of the support 1 as seen in FIG. 2*b* is a vacuum interrupter 16 having an actuating rod 16.1 extending radially of the axis 2A and a force storer 17. The interrupter 16 has conductors 16.2 and 16.3 by means of which it is connected across the fixed contacts 3 and 4 so that when it is closed it shunts out the switches formed by the contacts 3 and 4 and the respective contact assemblies 5 and 6. Normally the entire assembly is submersed in an insulating oil bath.

The force storer 17 has a main slide 17.1 displaceable along the axis 16A of the interrupter 16 on guide rods 17.3 and 17.4 fixed on the support 1 and another slide 17.2 slidable along an extension 17.5 of the rod 16.1. This slide 17.1 is provided with a cam-follower roller 17.6 riding in another endless cam groove 13.2 cut into the face of the cam 13 opposite the face with the groove 13.1. A spring 20 is braced between the slides 17.1 and 17.2 so that the latter tries to follow the former. An abutment ring 22 is fixed on the rod extension 17.5 above the slide 17.2 and axially engageable therewith, and a spring 21 is braced between the bottom of the slide 17.2 and the rod 16.1.

Upper and lower latch pawls 18 and 19 carrying respective actuation rollers 18.1 and 19.1 are urged by respective springs 18.2 and 19.2 toward the secondary slide 17.2 in such a manner that they can engage it and prevent it from moving respectively up and down, thereby compressing the spring 20. These pawls 18 and 19 can be pushed back by trip formations 17.7 and 17.8 of the main slide 17.1 once it has moved respectively up and down through a predetermined stroke to release the secondary slide 17.2.

Finally the upper end of the rod 16.1 is provided with a damper 23 comprised of a piston 23.1 carried on the rod extension 17.5 and a cylinder 23.2 closely surrounding it and subdivided by it into upper and lower compartments 23.6 and 23.7. A small opening 23.2 in the cylinder 23.2 at the lower compartment 23.7 vents same limitedly. The upper compartment 23.6 is centrally vented at a large opening 23.5, but the upper end of the rod 17.5 has an extension 23.4 that fits loosely in this opening to restrict its size in an upper position of the rod 17.5.

The cam groove 13.2 as shown in FIG. 4*a* is symmetrical to the plane P like the groove 13.2 and is also symmetrical to a plane P' perpendicular thereto. Thus for each 180° revolution of the shaft 2 the follower roller will be moved radially in one direction and then in the other, moving back and forth once between a down position and an up position. Seats 13.3 at the opposite ends of the groove 13.2 define stable positions for the follower 17.6 corresponding to the positions defined by the formations 13.4 of the groove 13.1.

The system described above functions as follows:

Assuming everything is in the illustrated positions and that the shaft 2 starts to rotate clockwise as seen in FIG. 2*a*, at first the lever 11 will be pivoted to pull the contact 5 away from the contact 3 while the lever 12 will remain generally stationary to keep the contacts 4 and 6 together. Simultaneously the follower 17.6 will start to move upward, tensioning the spring 20, but the upper stop pawl 18 will prevent the second slide 17.2 from moving up and, therefore, the interrupter 16 will remain closed. By the time the shaft 2 has rotated through about 90° the pusher 17.7 of the slide 17.1 will push back the pawl 18 and the slide 17.2 will be released. It will snap up, striking the abutment ring 22 and suddenly opening the vacuum interrupter 16. As the rod 16.1, 17.5 moves upward into its upper end position its extension 23.4 will move into the orifice 23.5 and fluid flow out of the upper chamber 23.6 is reduced, so that the speed of upward travel is greatly slowed.

Thus after about 90° degree of rotation of the shaft 2 the switch (equivalent to the switch P3 of FIG. 1A) of the contacts 3 and 5 is opened and the vacuum interrupter 16 (VS in FIG. 1A) is also opened. At this time the wiper (P4 in FIG. 1A) connected to the terminal 3 can be moved to the next tap, since it is completely open circuited and all current flow is through the other wiper (P1 in FIG. 1A). A geneva-wheel mechanism such as described in commonly assigned patent Ser. No. 07/674,758, filed Mar. 21, 1991, can be used to move the wiper terminals by means of the same shaft 2.

Further rotation through the second half of its first half revolution will reverse the above-described sequence of actions, moving the contact arm 5 back against the contact 3 and closing the interrupter 16. On the return stroke down by the slide 17.1, the pawl 19 blocks the inner slide 17.2 until the trip formation 17.8 of the outer slide 17.1 operates it to suddenly release this inner slide 17.2 and snap the interrupter 16 closed.

During a succeeding 180° of rotation the second wiper (P1 in FIG. 1A) connected to the terminal 4 is open circuited by first pulling back the contact arm 6 and then opening the interrupter 16, then the respective wiper is stepped to the tap to which the first wiper has already been moved, and the bypass switch and interrupter are again closed. This action therefore completes a tap change using a single vacuum interrupter.

We claim:

1. A switching system for a step transformer having at least two adjacent taps and a pair of terminals shiftable between the taps, the system comprising:

a support;

a pair of fixed contacts normally connected to the terminals and fixed on the support;

a vacuum interrupter on the support connected between the terminals and displaceable between an open-circuit position and a closed-circuit position;

a pair of movable contacts on the support each engageable with a respective one of the fixed contacts and forming therewith a respective bypass switch;

a cam rotatable about a cam axis and having a contact face and an axially oppositely facing interrupter face each formed with a respective operating formation;

drive means for rotating the cam about its axis through steps of a half revolution;

means including a respective cam follower engaged between each of the movable contacts and the contact-face formation for opening and closing one of the bypass switches on rotation of the cam through a half revolution and for thereafter opening and closing the other of the bypass switches on rotation of the cam through a succeeding half revolution; and means including a cam follower and a force storer engaged between the interrupter and the interrupter-face formation for snapping the interrupter open and then snapping the interrupter closed each time the cam is rotated through a half revolution.

2. The step-transformer switching system defined in claim 1 wherein the contact-face formation is annular and has one half that is generally centered on the cam axis and another half that is not centered on the cam axis, whereby the contact cam follower engaging the one centered half is not moved radially while the contact cam follower engaging the other uncentered half is moved radially on rotation of the cam.

3. The step-transformer switching system defined in claim 1 wherein the interrupter-face formation is generally symmetrical to two planes meeting at the cam axis, whereby the interrupter cam follower moves identically with each half revolution of the cam.

4. The step-transformer switching system defined in claim 1 wherein each movable contact includes a stack of separate contact plates engageable with the respective fixed contact and a frame surrounding the respective stack of plates.

5. The step-transformer switching system defined in claim 4 wherein one of the plates of each movable contact is mounted in the frame for greater displacement than the other plates of the respective stack and is made at least where it engages the respective fixed contact of tungsten.

6. The step-transformer switching system defined in claim 1 wherein the movable contacts are pivotal on the support.

7. The step-transformer switching system defined in claim 1 wherein the force storer comprising:

a main slide displaceable on the support and carrying the interrupter cam follower;

a secondary slide displaceable on an actuating rod of the vacuum interrupter and relative to the main slide; and spring means braced between the slides.

8. The step-transformer switching system defined in claim 7 wherein the support includes guide rods along which the main slide is slidable.

9. The step-transformer switching system defined in claim 7 wherein the force storer further comprises latch means for restraining the secondary slide against movement along the actuating rod during movement of the main slide until the main slide has moved through a predetermined stroke.

10. The step-transformer switching system defined in claim 7 wherein the force storer has a spring braced between the secondary slide and the rod.

11. The step-transformer switching system defined in claim 1 wherein the interrupter has an actuating rod movable through a predetermined stroke on opening and on closing, further comprising damping means for damping movement of the actuating rod at the ends of its stroke.

12. The step-transformer switching system defined in claim 11 wherein the damping means includes a cylinder fixed on the support; and a piston carried on the rod and subdividing the cylinder into a pair of generally closed compartments, each of the compartments being formed with a vent aperture of limited flow cross section.

13. The step-transformer switching system defined in claim 1 wherein the formations are provided with seats for the respective cam followers and the cam followers are received stably therein in two 180° offset positions of the cam.

* * * * *